US005499724A

United States Patent [19]

Hickman

[11] Patent Number: 5,499,724

[45] Date of Patent: Mar. 19, 1996

[54] WALL MOUNTED TOOL RACK FOR THE STORAGE OF HAND TOOLS

[76] Inventor: Claude R. Hickman, 1630 Highland Oaks Dr., Arcadia, Calif. 91006

[21] Appl. No.: 291,534

[22] Filed: Aug. 16, 1994

Related U.S. Application Data

[63] Continuation of Ser. No. 17,499, Jan. 1, 1994, Pat. No. Des. 364,769.

[51] Int. Cl.[6] ..... A47F 5/08

[52] U.S. Cl. ..... 211/70.6; 211/87; 211/59.1

[58] Field of Search ..... 211/87, 69, 68, 211/67, 66, 65, 70.1, 70.6, 59.1, 57.1, 105.1; 248/220.3; 411/397, 107; 403/22, 342

[56] References Cited

U.S. PATENT DOCUMENTS

| | | | |
|---|---|---|---|
| 2,730,243 | 1/1956 | Platt | 211/59.1 X |
| 5,059,055 | 10/1991 | DeGress et al. | 403/24 |
| 5,097,966 | 3/1992 | Miller | 211/87 |
| 5,145,135 | 9/1992 | Thompson | 248/201 |
| 5,193,694 | 3/1993 | Wave | 211/70.5 |
| 5,407,170 | 4/1995 | Slivon et al. | 248/552 |

FOREIGN PATENT DOCUMENTS

| | | | |
|---|---|---|---|
| 36971 | 6/1967 | Finland | 211/87 X |
| 1229028 | 9/1960 | France | 211/87 X |

*Primary Examiner*—Robert W. Gibson, Jr.
*Attorney, Agent, or Firm*—Frederick Gotha

[57] ABSTRACT

A tool rack suspendable from a wall by attachment to vertical wall studs which incorporates a frame member having a plurality of holes spaced for alignment with the standardly spaced vertical wall studs. Cantilever pins are permitted to be removably mounted to the frame member by accessibility to the rear planar surface of the frame member through a multiplicity of void regions located in the lower flange. The lower flange projects laterally from the frame member and is integral therewith. An upper flange member projects substantially parallel to and in the same direction as the lower flange and the upper flange has a width which is less than that of the lower flange such that when the tool rack is mounted to the vertical wall studs the frontal planar surface of the frame member is rearwardly sloped with respect to the vertical.

10 Claims, 4 Drawing Sheets

WALL MOUNTED TOOL RACK FOR THE STORAGE OF HAND TOOLS

This application is a continuation of U.S. patent application Ser. No. 29/017,499, filed Jan. 1, 1994, now U.S. Pat. No. Des. 364,769.

FIELD OF THE INVENTION

This invention relates to a wall mounted took rack device having removably mounted cantilever pins for selectively spacing and hanging hand tools.

BACKGROUND OF THE INVENTION

Wall racks for the storage and organization of household and garden tools have long existed in the prior art. Where various tool sizes, shapes and weights are desired to be hung on a wall mounted tool rack, it is desirable to securely mount the rack to the vertical wall studs supporting the wall thereby permitting much more weight to be suspended from the rack. Also, since the tools are of differing sizes and shapes, it is further desirable to organize their storage in a manner which promotes an economy of storage space.

SUMMARY OF THE INVENTION

There is, therefore, provided according to the present invention, a wall mounted tool storage rack which may be rigidly mounted to the vertical wall studs that frame the walls of a room while also promoting an economy of storage space by utilizing removably mounted cantilever pins from which the tools are suspended.

The present invention is directed to a wall mounted tool rack device for direct mounting to standardly spaced vertical wall studs. The rack consists of an elongated frame member having an axis of elongation, a frontal planar surface and a rear planar surface which are substantially parallel, and an axially extending lower flange which is integrally carried by the frame member and projects a fixed lateral distance therefrom. The frame member has an axially extending upper flange integrally carried by the frame which projects a fixed distance laterally therefrom in the lateral direction of the lower flange. The upper flange is substantially parallel to and vertically spaced from the lower flange and the fixed distance or width of the lower flange is dimensionally greater than the fixed distance or width of the upper flange. The frame member has a plurality of axially spaced holes through which fasteners are extended for mounting the frame to vertical wall studs and also contains a plurality of axially spaced cantilever pin openings which are located adjacent to the lower flange for the insertion of cantilever pins. The lower flange has a multiplicity of void regions where each such region is adjacent to one of the cantilever pin openings and so dimensioned and proportioned to permit access to the rear planar surface of the frame through the void region after the frame is rigidly mounted to a wall. Accessibility to the rear planar surface of the frame permits the cantilever pins to be removeably mountable through the cantilever pin openings and thereafter secured to the frame member. Thus, the distance between tools which are suspended from the cantilever pins can be selectively controlled and economy of storage space achieved.

BRIEF DESCRIPTION OF THE DRAWINGS

These and other features and advantages will become appreciated as the same become better understood with reference to the following specification, claims and drawings wherein:

DETAILED DESCRIPTION

Figure 1:
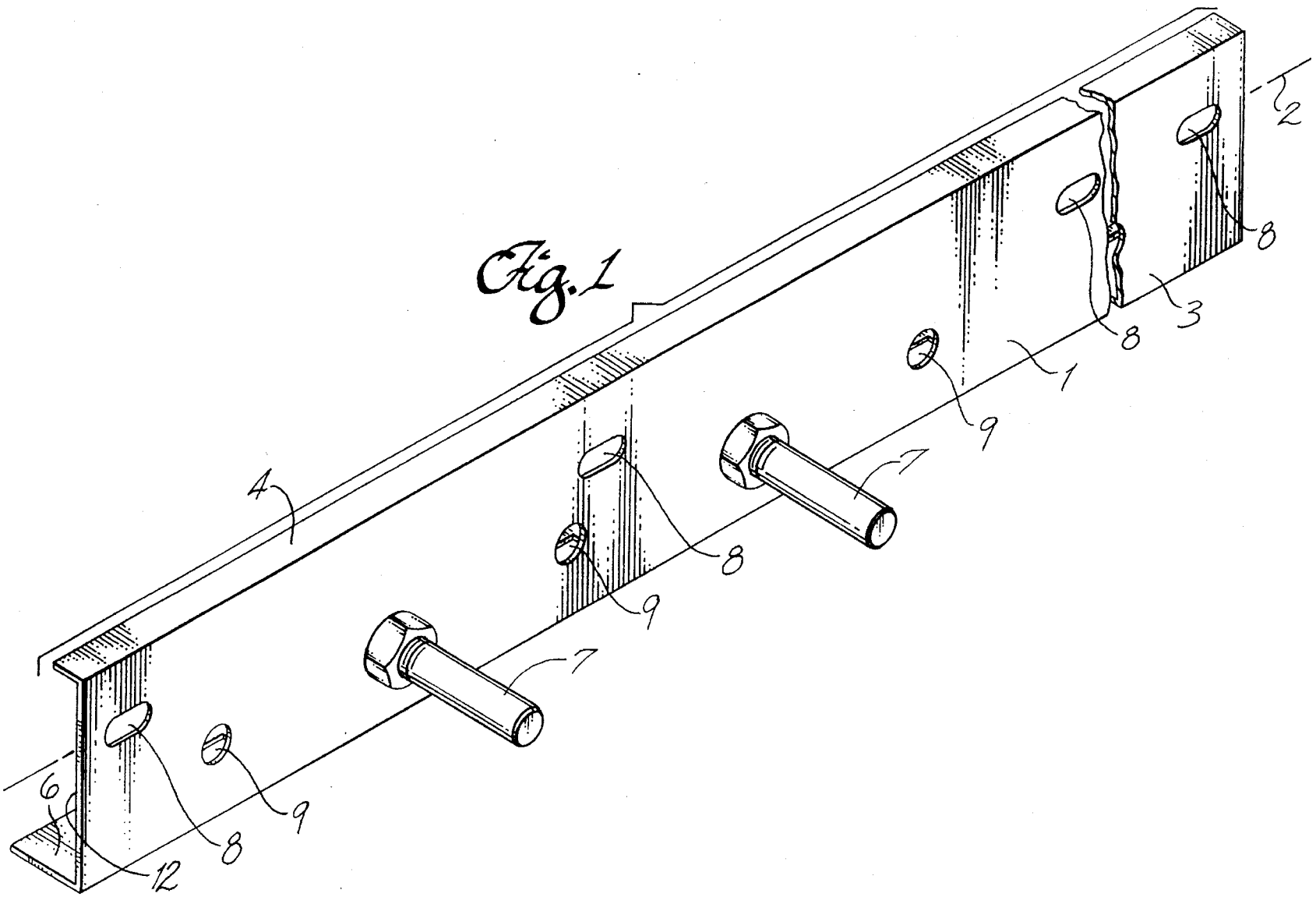
FIG. 1 is a frontal perspective view of the tool rack of this invention.
Figure 2:
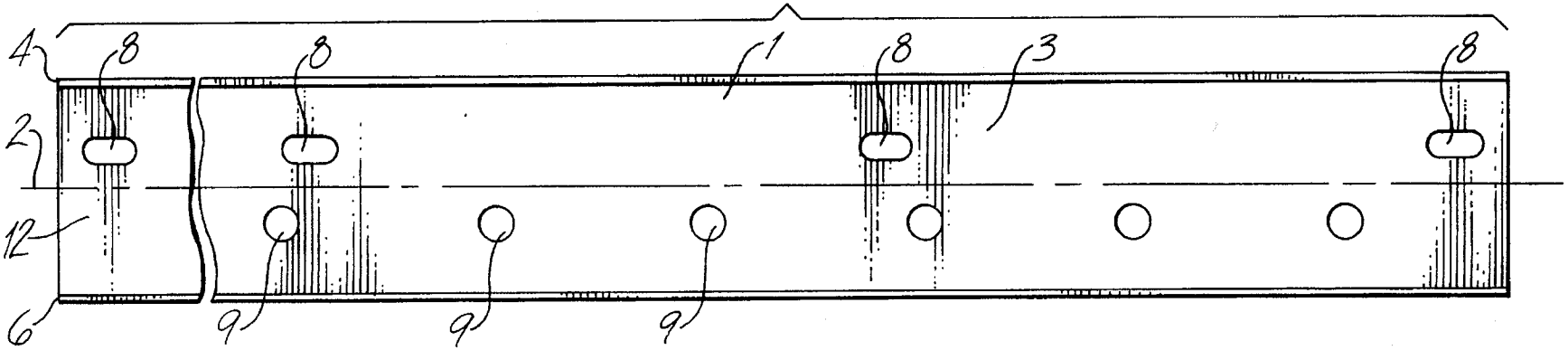
FIG. 2 is a rear view of FIG. 1 with the cantilever pins removed.
Figure 3:
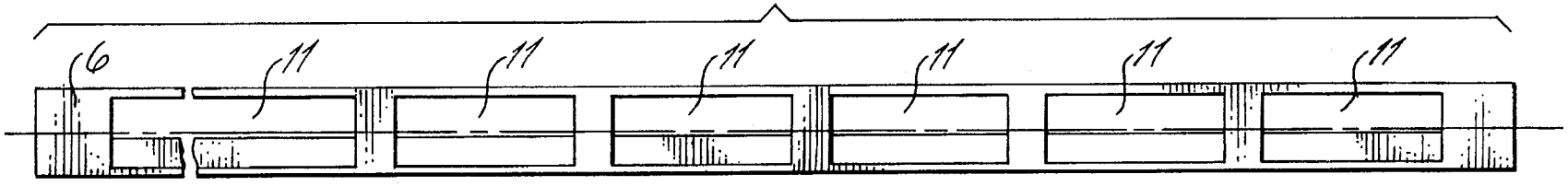
FIG. 3 is a bottom view of FIG. 2.

In FIG. 1, a perspective view is shown of the tool rack 1 of this invention. FIG. 2 illustrates a rear view of tool rack 1 shown in FIG. 1; and FIG. 3 is a bottom view of the tool rack. Referring now to FIGS. 1 and 2, it can be seen that tool rack 1 has an axis of elongation 2, a frame member 3, and an upper flange 4 extending laterally from frame member 3 and a lower flange 6 integrally formed with an extending laterally from frame member 3 in the same direction as upper flange 4. Preferably, the upper flange 4 extends laterally from the frame member a distance of ½ inches and the lower flange extends a distance of 1¼ inches; the width of the frame member measured between the upper and lower flanges is preferably a distance of 3 inches. Thus, when the rack member bears against a vertical wall, the cantilever pins 7 from which the tools are to be suspended form an angle of approximately 14 degrees with the horizontal plane. The upward incline of the cantilever pins 7 prevent a tool suspended from the cantilever pin to slip from the rack.

The frame member 3 illustrated in FIGS. 1 and 2 has a plurality of axially spaced holes 8 which are preferably spaced eight inches apart. Holes 8 permit the tool rack 1 to be mounted to vertical wall studs which conform to the Uniform Building Code standards that require the vertical wall studs to be 16 inches apart. The holes 8 are elongated to provide sufficient tolerance to accommodate for variances in the 16 inch separation which will exist in the spacing of the vertical wall studs during their installation.

Figure 5:
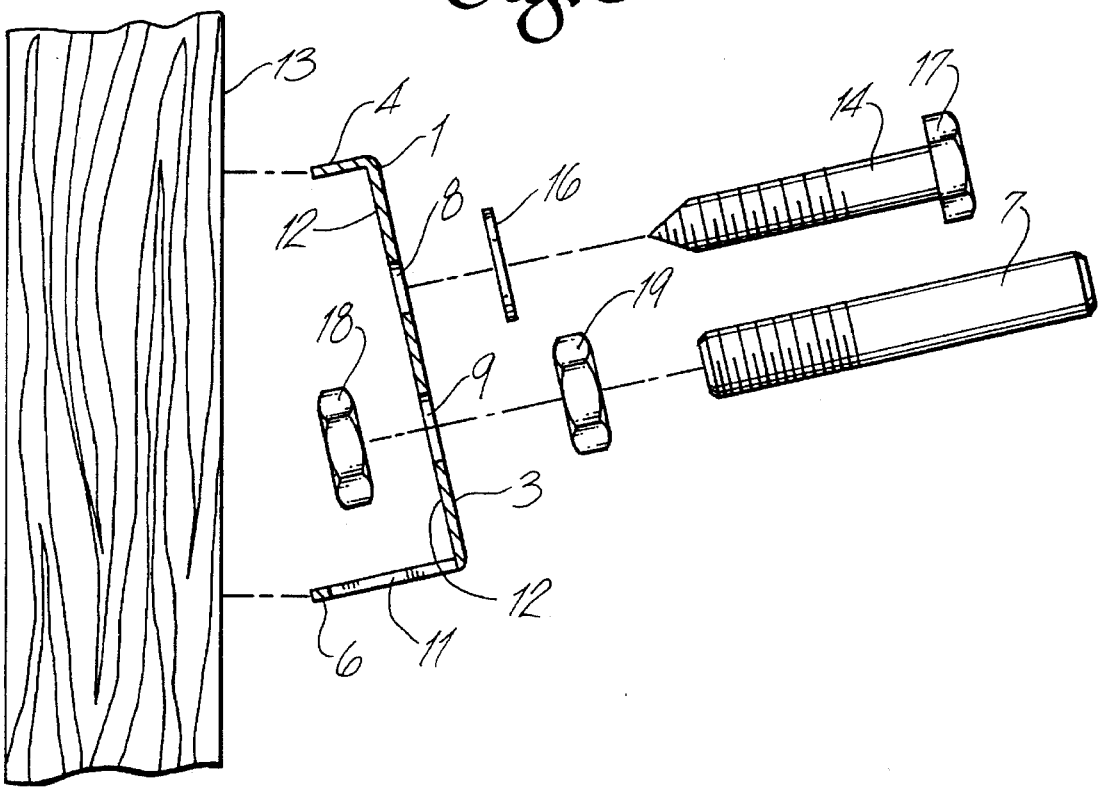
FIG. 5 is a side cross-sectional view of the tool rack before being fastened to a vertical wall stud.
Figure 6:
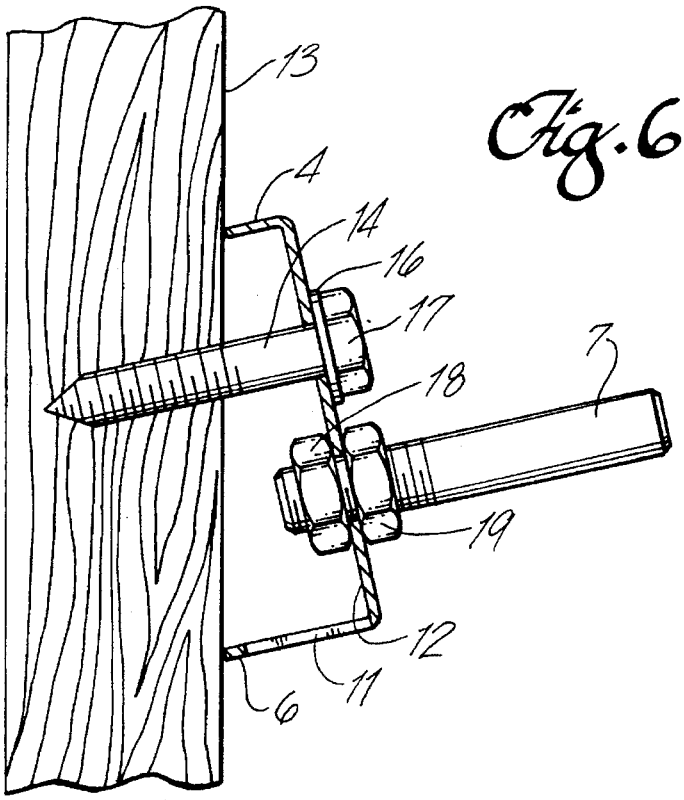
FIG. 6 illustrates a side cross-sectional view of the tool rack after being secured to vertical wall studs and illustrates the cantilever pin fastened to the frame of the tool rack.

The economy of space for suspending tools of various sizes is achieved through the use of a multiplicity of cantilever pin openings 9 which are preferably spaced three inches apart. The cantilever pin openings are located adjacent the lower flange 6 which, as can be seen in FIG. 3, has a plurality of void regions 11. These regions are rectangularly shaped and permit access to the rear surface 12 of frame member 3 when the tool rack is mounted to and bears against a vertical wall. As can be seen in FIGS. 5 and 6, accessibility to the rear surface of frame member 3 permits the cantilever pins 7 to be removably mounted and selectively spaced in an axial direction.

Figure 4:
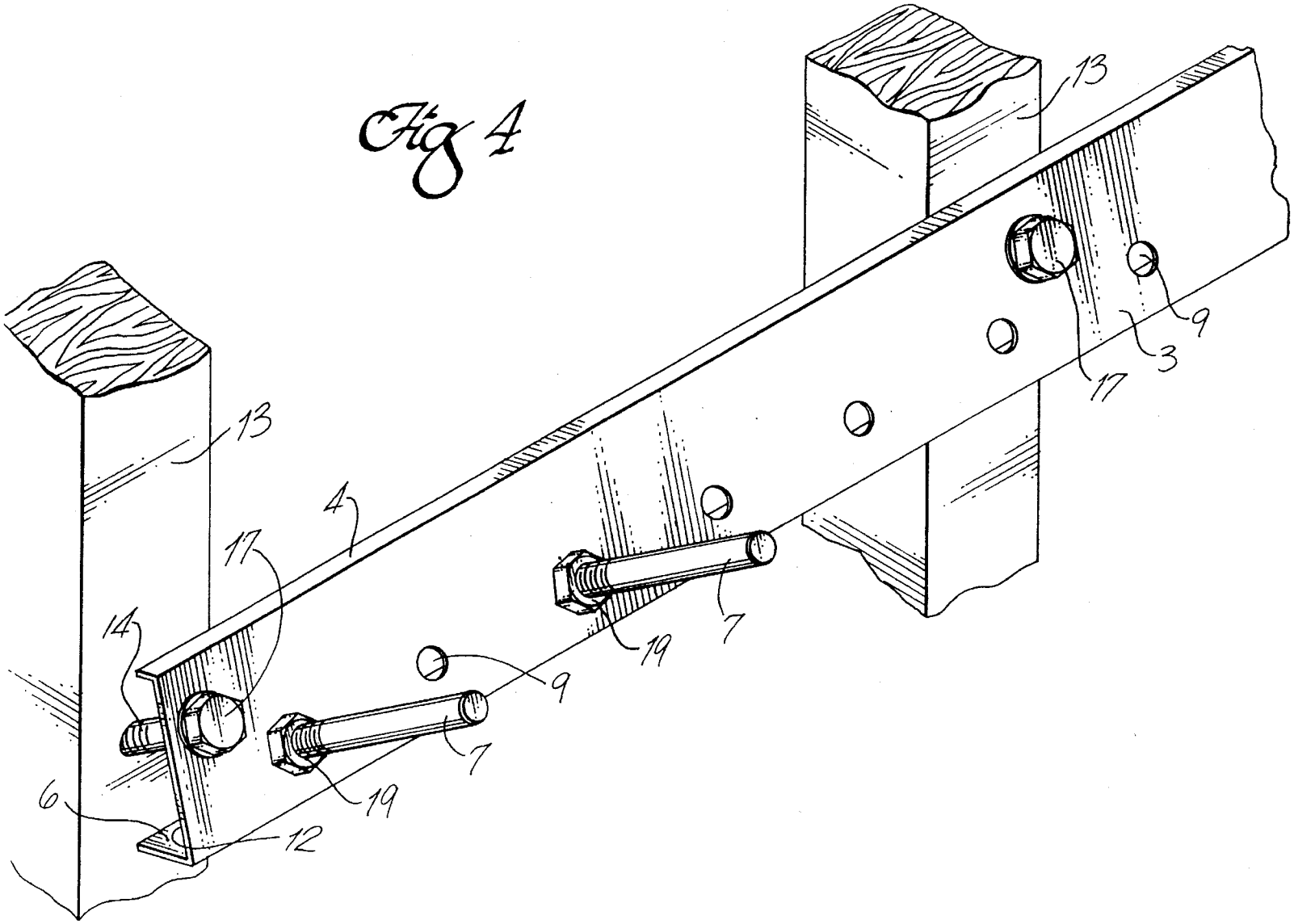
FIG. 4 is a perspective view of a section of the tool rack mounted to the vertical wall studs.

FIGS. 4 and 6 illustrate the tool rack 1 fastened to the vertical wall studs 13. By referring to FIG. 5, it can be seen that a fastener member 14 is insertable through hole 8 for securing tool rack 1 to vertical wall stud 13. A washer 16 is shown in FIG. 5 to provide a bearing surface for the head 17 of fastener member 14 after it is tightened against frame member 3 during the mounting of the rack to the vertical wall stud. As can further be seen in FIG. 5 the mounting nuts 18 and 19 are utilized to removably mount cantilever pin 7 to the tool rack 1. After the tool rack 1 is mounted to the vertical wall studs 13, nut 18 becomes accessible through a void region 11. This permits nut 18 to be threaded onto cantilever pin 7 from the rear after cantilever pin 7 is inserted through cantilever pin opening 9 to mount cantilever pin 7 to frame member 3. Void region 11 also permits nut 18 to be unthreaded to remove cantilever pin 7 after that tool rack has been mounted to the wall.

Tool rack 1 is preferably made of a heavy gauge material such as a 14 gauge galvanized sheet metal which promotes strength and durability and permits the tool rack to be rolled and stamped utilizing standard manufacturing processes.

While I have shown and described a wall mounted tool rack having removably mounted cantilever pins, it is to be understood that the tool rack is subject to many modifications without departing from the scope and spirit of the claims as recited herein.

What is claimed is:

1. A tool rack suspended from a wall by fastener members attached to the vertical wall studs comprising:

(a) an elongated frame member having a frontal surface and a rear surface and an axis of elongation;

(b) an axially extending lower flange integrally carried by said frame member and in fixed relationship therewith projecting laterally from said rear surface, said frame member having a plurality of axially spaced holes so dimensioned and proportioned to permit said fastener members to pass in part through said axially spaced holes and to compressively bear against said frontal surface of said frame member thereby allowing said frame member to be rigidly mounted to said vertical wall studs, said frame member further having a plurality of axially spaced cantilever pin openings adjacent said lower flange and extending through both said frontal surface and said rear surface, said lower flange having a multiplicity of void regions adjacent said cantilever pin openings where said void regions are so dimensioned and proportioned to permit access to said rear surface and said cantilever pin openings through said void regions after said frame member is mounted to said wall.

2. The rack device recited in claim 1 further comprising a cantilever pin member having a first and second end where said first end is so dimensioned and proportioned to permit said first end to pass in part through said cantilever hole laterally in the direction of said vertical wall studs and means for removably mounting said cantilever pin to said elongated frame member.

3. The rack device recited in claim 1 wherein said axially spaced holes are equidistantly spaced a sufficient distance to permit at least two of said axially spaced holes to be in respective alignment with at least two of said vertical wall studs.

4. The rack device recited in claim 3 wherein said axially spaced holes are spaced a distance of 8 inches.

5. The rack device recited in claim 4 wherein said cantilever pin openings are spaced a distance of 3 inches.

6. The rack device recited in claim 1 further comprising an axially extending upper flange integrally carried by said frame member in fixed relationship therewith and projecting laterally from said rear surface in substantially the same direction as said lower flange where said lower flange has a lateral dimension greater than said upper flange.

7. The rack device recited in claim 6 further comprising a cantilever pin member having a first and second end where said first end is so dimensioned and proportioned to permit said first end to pass in part through said cantilever hole laterally in the direction of said vertical wall studs and means for removably mounting said cantilever pin to said elongated frame member.

8. The rack device recited in claim 7 wherein said axially spaced holes are equidistantly spaced a sufficient distance to permit at least two of said axially spaced holes to be in respective alignment with at least two of said vertical wall studs.

9. The rack device recited in claim 8 wherein said axially spaced holes are spaced a distance of 8 inches.

10. The rack device recited in claim 9 wherein said cantilever pin openings are spaced a distance of 3 inches.

* * * * *